US006733018B2

(12) United States Patent
Razon

(10) Patent No.: US 6,733,018 B2
(45) Date of Patent: May 11, 2004

(54) ADJUSTABLE LEG SUPPORT AND SEATED TO STAND UP WALKER

(76) Inventor: Eli Razon, 1478 Dillon Rd., Maple Glen, PA (US) 19002

( * ) Notice: Subject to any disclaimer, the term of this patent is extended or adjusted under 35 U.S.C. 154(b) by 0 days.

(21) Appl. No.: 10/056,829

(22) Filed: Jan. 24, 2002

(65) Prior Publication Data

US 2003/0137119 A1 Jul. 24, 2003

(51) Int. Cl.[7] ..... A61H 3/04

(52) U.S. Cl. ..... 280/87.021; 280/87.03; 280/87.05; 135/67

(58) Field of Search ..... 280/87.021, 87.03, 280/87.051, 87.05; 135/65, 67, 69, 74, 75, 84, 85; 5/81.1 R, 83.1, 86.1

(56) References Cited

U.S. PATENT DOCUMENTS

| | | | | | |
|---|---|---|---|---|---|
| 2,327,671 | A | * | 8/1943 | Rupprecht | 5/83.1 |
| 2,903,238 | A | * | 9/1959 | Flandrick | 5/83.1 |
| 3,252,704 | A | * | 5/1966 | Wilson | 5/83.1 |
| 3,374,493 | A | * | 3/1968 | Herrera | 5/83.1 |
| 3,394,933 | A | * | 7/1968 | Benoit | 135/65 |
| 3,568,226 | A | * | 3/1971 | Mater et al. | 135/65 |
| 3,596,298 | A | * | 8/1971 | Durst, Jr. | 5/83.1 |
| 4,682,377 | A | * | 7/1987 | Reich | 7/87 |
| 4,890,853 | A | * | 1/1990 | Olson | 5/83.1 |
| 5,117,516 | A | * | 6/1992 | Penner | 5/83.1 |
| 5,172,715 | A | * | 12/1992 | Webb | 135/67 |
| 5,309,584 | A | * | 5/1994 | Parker | 5/83.1 |
| 5,396,670 | A | * | 3/1995 | Firebaugh et al. | 5/89.1 |
| 5,411,044 | A | * | 5/1995 | Andolfi | 135/66 |
| 5,878,450 | A | * | 3/1999 | Bouhuijs | 5/86.1 |
| 6,099,002 | A | * | 8/2000 | Uchiyama | 280/87.021 |
| 6,135,131 | A | * | 10/2000 | Downing | 135/67 |
| 6,175,973 | B1 | * | 1/2001 | Hakamiun et al. | 5/89.1 |

* cited by examiner

*Primary Examiner*—Brian L. Johnson
*Assistant Examiner*—Jeffrey J. Restifo
(74) *Attorney, Agent, or Firm*—John B. Sowell-Atty.

(57) ABSTRACT

A stand up walker for supporting body weight in a standing position with a pair of upper lift arms pivotally mounted on a walker frame and having lift spring mounted on the walker frame. In the preferred embodiment a pair of lift springs comprise gas springs for asserting a lifting force to the body by a body seat and harness coupled to the upper lift arms. However, the upper lift arms may be provided with resilient handles that apply the lifting force under the armpits or a combination of lifting forces may be employed.

13 Claims, 9 Drawing Sheets

ADJUSTABLE LEG SUPPORT AND SEATED TO STAND UP WALKER

BACKGROUND OF THE INVENTION

1. Field of the Invention

The present invention relates to walkers employed to assist a person in walking. More particularly, the present invention relates to a novel stand up walker having a pair of adjustable upper arms coupled to gas springs and a harness which lifts and supports the body of a person rising from a seated position and supports the body weight while walking.

2. Description of the Prior Art

Walkers with four legs are well known. Such walkers permit a person to support their body through their arms while standing or walking, but offer no real lifting assistance when rising from a seated position or when sitting down.

Prior art walkers have been provided with sets of front wheels. This permits the person to move the walker forward before stepping forward one or two short steps in a shuffle step while leaning on the walker.

Walkers with four sets of wheels are known as rollers and must be provided with a releasably normally-on braking system on at least two of the wheels. If no brakes are provided, any lateral thrust allows the roller walker to move away from the person using the roller walker, thus creating a hazardous situation.

Manual and electric patient lift mechanisms are known for assisting people from a seated or lying position to a wheelchair or some other form of stationary support. Such patient lift mechanisms require one or two operators to position and operate the crane-like mechanism and at least one other to assist the patient.

It would be extremely desirable to provide a novel walker which can be operated by a single person or patient alone and accomplish all of the needed functions of a patient lift mechanism as well as a walker or roller.

SUMMARY OF THE INVENTION

It is a primary object of the present invention to provide a novel walker that permits a seated person to stand and walk or vice versa with minimum of effort.

It is a primary object of the present invention to provide a novel walker or roller which permits a patient to adjust the amount body weight to be carried by the walker when in a walking mode.

It is a primary object of the present invention to provide a rehabilitation walker for persons that cannot carry full body weight on the limbs or joints during rehabilitation.

It is a primary object of the present invention to provide a rehabilitation walker for persons that ordinarily would be restricted to a wheelchair by having the walker support enough body weight to permit walking with an adjustable and minimal weight on the legs while propelling themselves in the novel walker.

It is a primary object of the present invention to provide a walker for assisting the walking of amputees especially the elderly and those having a problem adjusting to a new amputation.

It is a primary object of the present invention to provide immobilized or wheelchair patients with a novel exercise walker that can be used for gaining leg strength and exercising.

It is a primary object of the present invention to provide a rehabilitation walker for persons that have pulmonary disease or heart disease that previously could only walk a few steps without tiring or risking physical harm.

It is a general object of the present invention to provide any handicap person with a foldable or storable walker device that permits assisted walking, assisted standing and assisted seating so that can live a fuller life without depending on help from others.

According to these and other objects of the present invention there is provided a four-legged walker with wheels on each of the legs. The walker is provided with a pair of upper lifting arms coupled to a pair of lifting springs. A body harness, worn by the person using the walker, transfers an adjustable amount of body weight to the upper support arms and thus into the walker support frame so that a person inside of the walker is able to walk with a pre-determined force on the leg joints and limbs.

DESCRIPTION OF THE PREFERRED EMBODIMENTS

Figure 1:
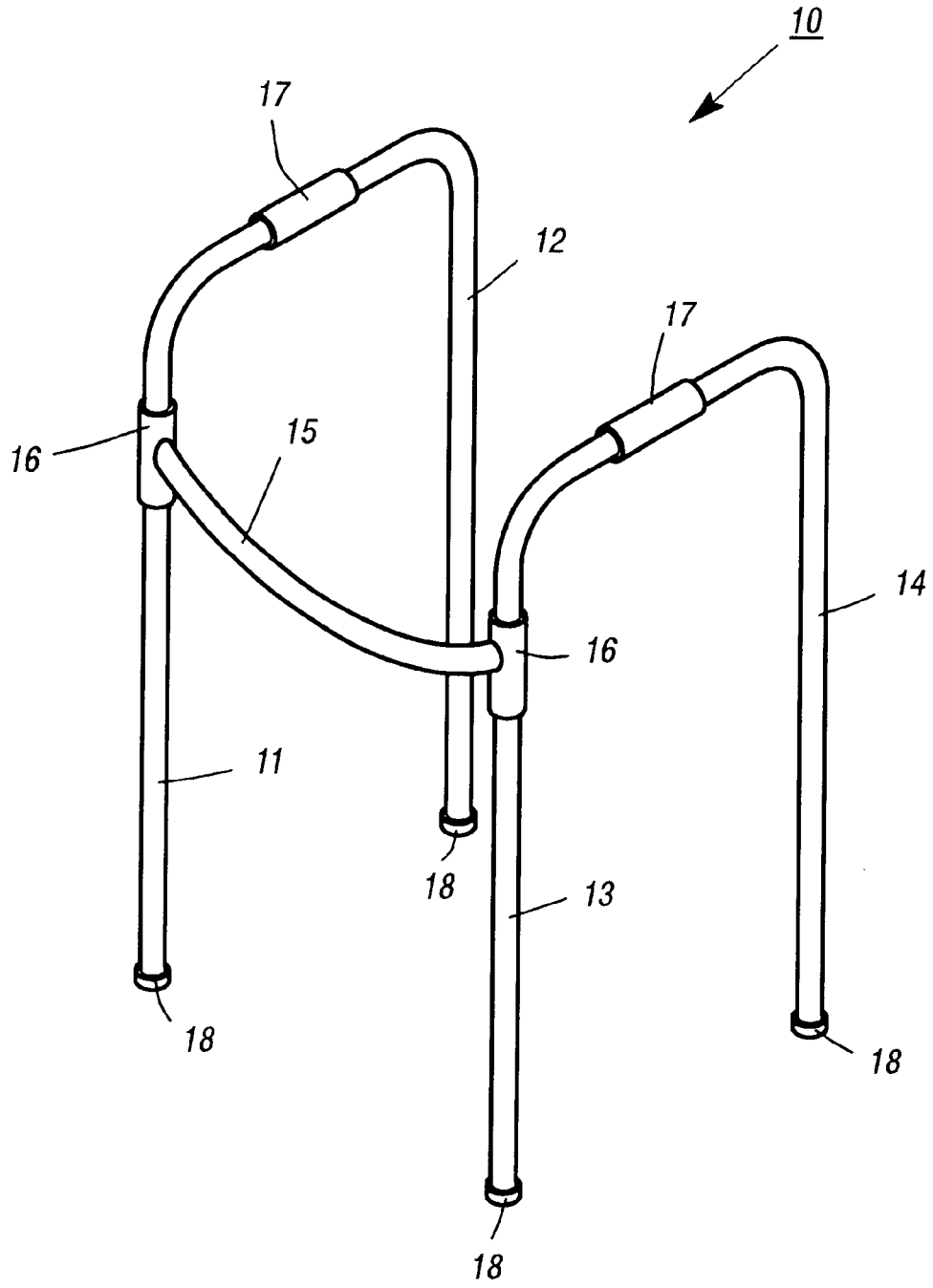
Figure 1 (Prior Art)
FIG. 1 is an isometric drawing of a prior art folding walker with four vertical legs.

Refer now to FIG. 1 showing a prior art folding walker 10 having four vertical legs 11 to 14. A crossbar 15 is provided with two hollow sleeves 16 at each end to accept therein the front legs 11 and 13. Resilient handles 17 are provided on the connecter or transition pipe of the front and rear legs. Rubber tips 18 are provided on the ends of the four legs to provide both traction and gripping. The sleeves 16 provide means for folding the rear legs 12 and 14 against the crossbar 15. The walker is preferably made from a strong lightweight tubing material such as aluminum.

Figure 2:
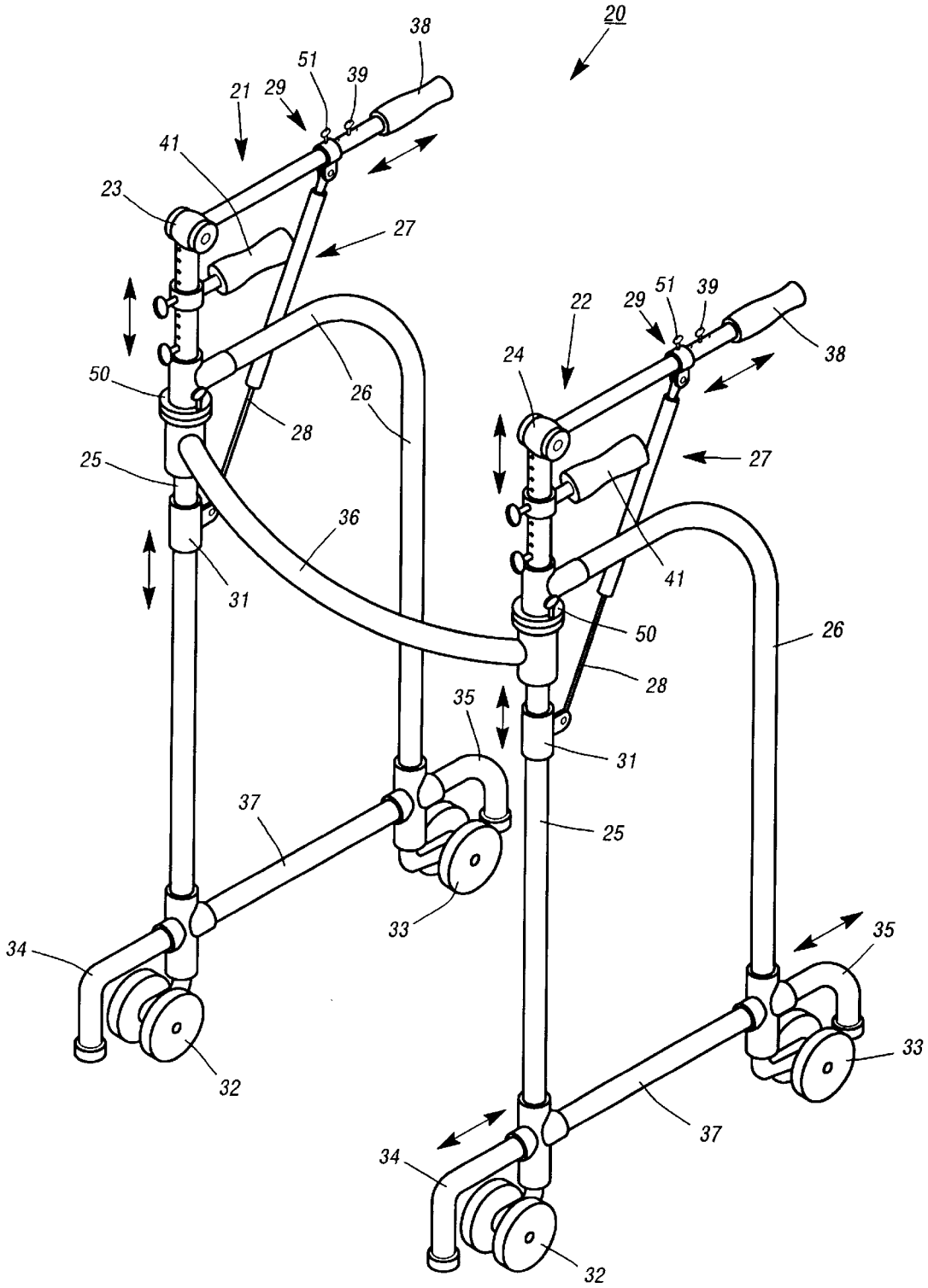
FIG. 2 is an isometric drawing of a preferred embodiment stand up walker of the present invention with four vertical legs and a pair of pivoting support arms.

Refer now to FIG. 2 showing an isometric drawing of the preferred embodiment stand up walker of the present invention having two vertical front legs 25 and two vertical rear legs 26 and a pair of pivoting support arms 21 and 22. The support arms 21 and 22 are shown pivoting at the top of the legs 25 via pivots 23 and 24. The preloaded gas springs 27 are provided with piston rods 28 shown downwardly extending and connected to the legs 25 by lower connecters 31 and the gas cylinder is shown connected to the support arms 21 and 22 via upper connecters 29. It will be understood that the connecters 29 are moveable on the support arms so as to adjust the amount of supporting force applied by the gas springs 27. Further, the gas springs 27 may be reversed in their orientation so that the cylinder is at the lower most position. Further, it will be understood that the lower connecters 31 are preferably adjustable on the legs 25 so as to adjust the height and angle of the arms 21 and 22.

Front wheels 32 are preferably swiveled for steering and the rear wheels 33 may be fixed. Outriggers 34 and 35 are preferably adjustable in the horizontal direction and extend in and out of the hollow horizontal frame members 37. The cross member 36 is provided with sleeves similar to that described in FIG. 1 and pivot and pin members are provided to lock the rear legs 26 from moving or folding. Vertically adjustable handles 41 are fixedly mounted on an extension of the legs 25. The movable handles 38 are mounted at the end of the support arms 21 and 22 and preferably comprise a resilient material. A hook or horn device 39 is provided on the support arms 21 and 22 for rapidly mounting the harness which is connected to the seating structure to be described in more detail hereinafter.

Figure 3:
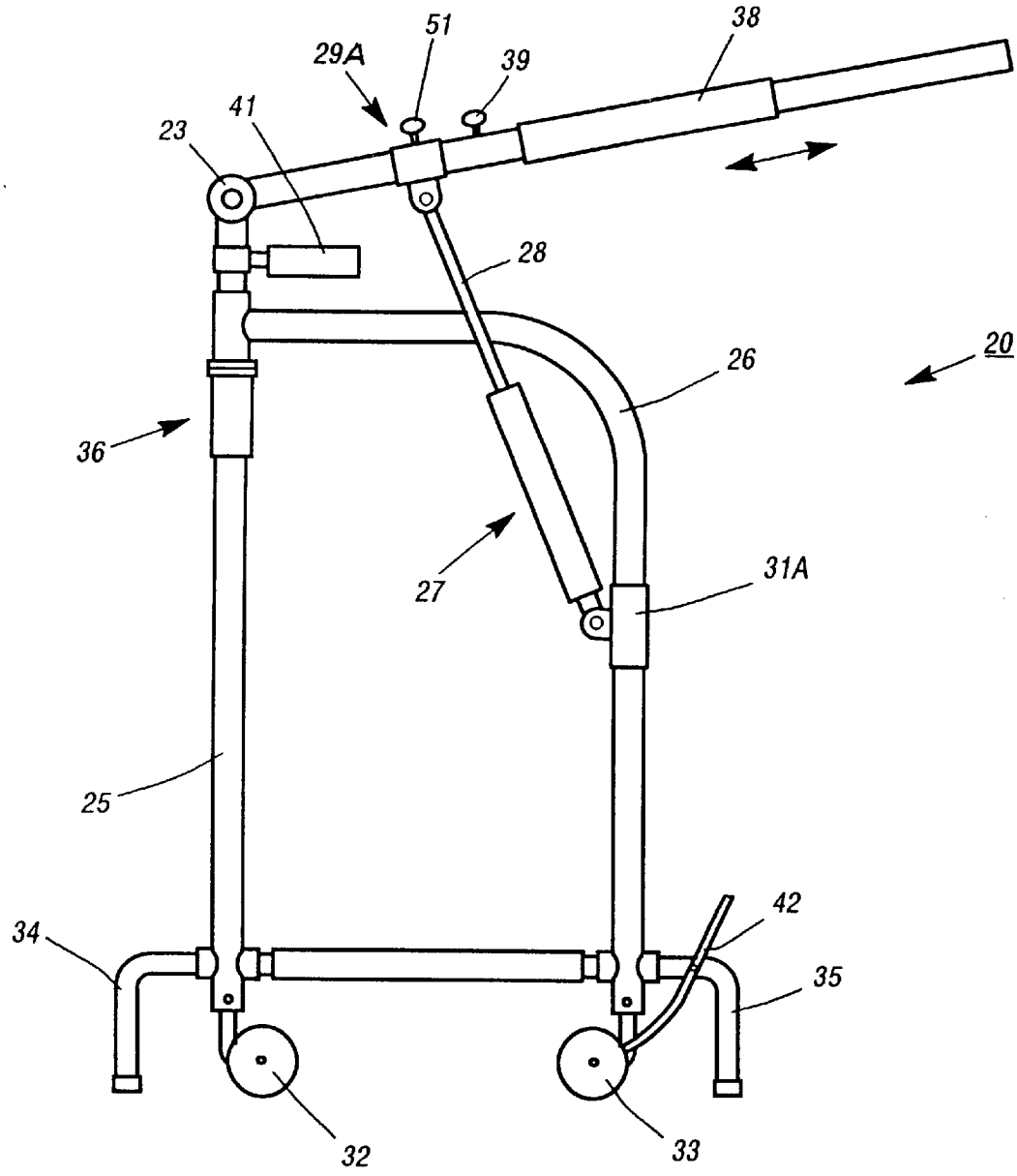
FIG. 3 is a side view of the stand up walker held in FIG. 2 showing extension levers for pre-loading the gas springs on the lifting or support arms.

Refer now to FIG. 2 showing in side view the novel stand up walker shown in FIG. 2 with the gas springs 27 reversed. The numbers used to indicate the elements in FIG. 3 are identical to those shown and described in FIG. 2, thus do not require additional explanation. The upper connecter 29A and the lower connecter 31A are modified to be mounted on the support arms 21 or 22 and the vertical legs 26, respectively. Further, there is shown a typical well-known brake mechanism 42 which engages the rear wheels 33 to prevent movement of the walker 20 when a horizontal force is applied. A retractable lever 38A is shown extended from handle 38.

Figure 4:
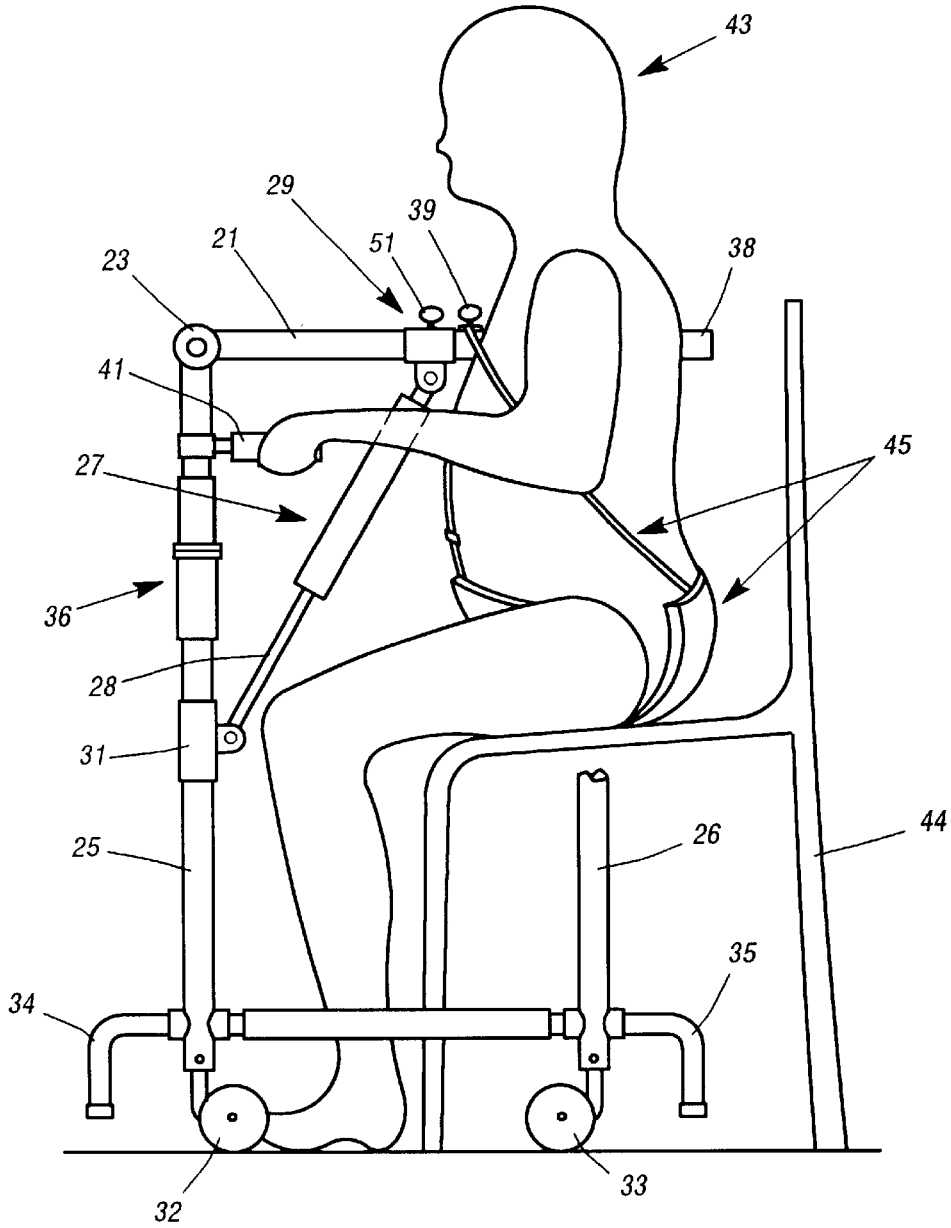
FIG. 4 is a side view of the stand up walker of FIGS. 2 and 3 showing a person seated on a chair prior to being raised to a stand up position by assistance of the pre-loading gas springs and a body harness.

Refer now to FIG. 4 showing a side view of the novel stand up walker of FIGS. 2 and 3 and also showing a person 43 seated on a chair 44 prior to being raised to a stand up position by assistance of the pre-loaded gas springs 27 and the body harness 45 which will be described in more detail hereinafter. The harness straps are shown connected to the hook 39 on the arm 21. It will be explained that the gas spring 27 pulls on the harness 45 and assists the patient 43 in sitting down or in rising from the chair 44 while holding onto the handles 41 described hereinbefore. The numerals shown in FIG. 4 that are the same as the numerals used in FIGS. 2 and 3 are identical and do not require additional explanation.

Figure 5:
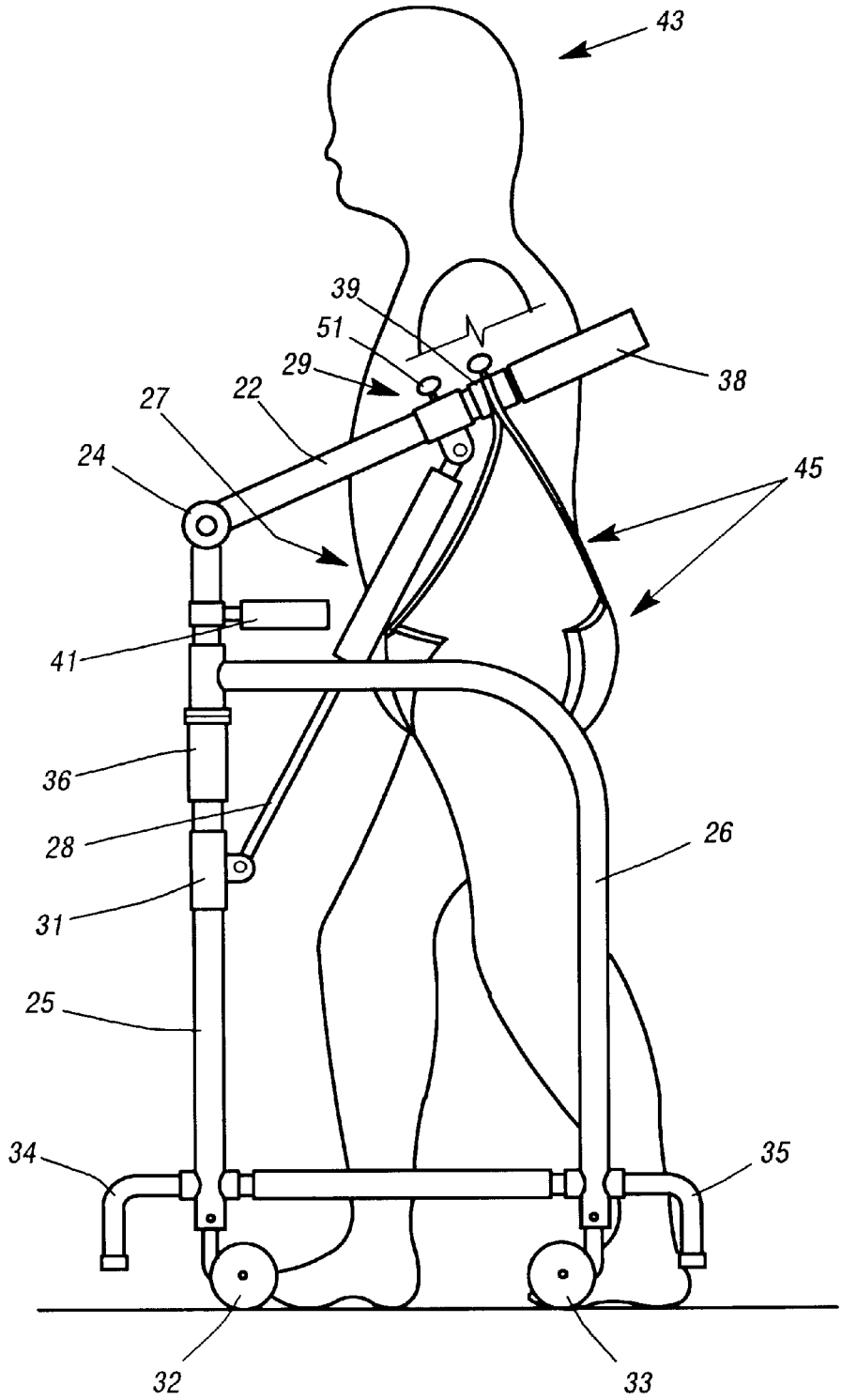
FIG. 5 is a side view of the stand up walker of FIGS. 2 to 4 showing a person standing and assisted in a walking position by the novel stand up walker having springs and a body harness.

Refer now to FIG. 5 showing a side view of the novel stand up walker shown in FIGS. 2 to 4 and showing a person standing inside the walker being assisted by the harness 45 and gas spring 27. To show the harness and gas spring in better detail the arm of the person 43 which extends outward and over the arm 22 has been removed. It can be seen that the upper connecter 29 can be moved laterally on the arm 22 to adjust the force on the arm 22 which has a handle 38 which snuggles underneath the arm of the person 43. The angle or height of the handle 38 is better adjusted by the lower connecter 31. The numerals used in FIG. 5 which are the same as those shown in FIGS. 2 to 4 are identical and operate in the same manner as described hereinbefore.

Figure 6:
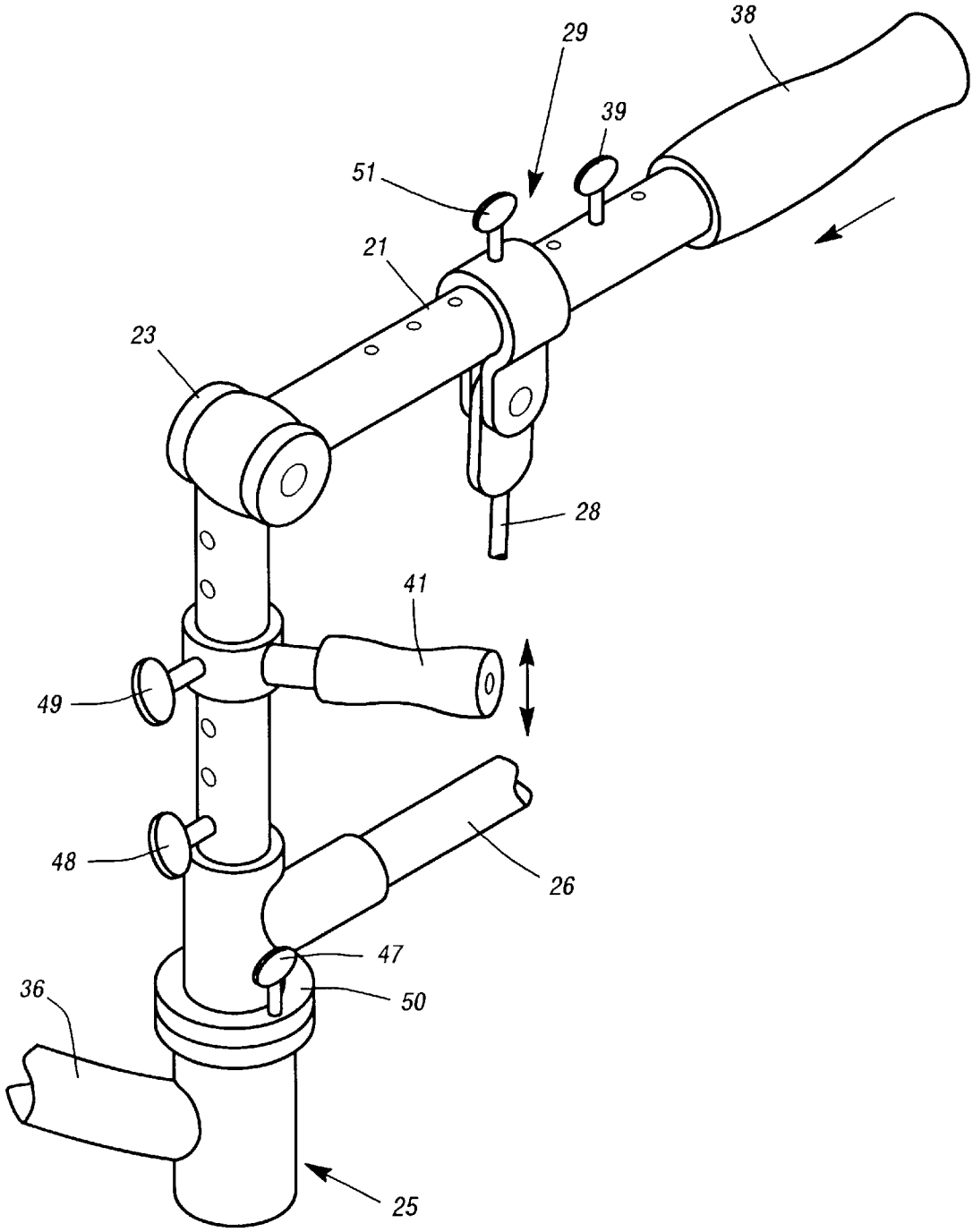
FIG. 6 is an enlarged detail of the left side upper support arm of the stand up walker showing vertical and horizontal arm adjusters and a hook for attaching the harness.

Refer now to FIG. 6 showing an enlarged detail drawing of the right side upper arm 21 of the stand up walker showing vertical and horizontal arm adjusters and a hook for rapidly attaching and disconnecting the harness. The vertical front leg 25 supports a crossbar 36 on which is mounted the upper part of leg 25 including a flange support assembly 50. The flange assembly 50 permits the upper part of leg 25 to be released at locking pin 47 so that the upper portion 26 of rear leg 25 can be folded parallel to crossbar 36. There is provided an upper arm pin 48 to permit vertical adjustment of the upper portion of leg 25 which includes a handle 41 and a handle adjustment pin 49. The top of leg 25 has a pivot 23 for receiving pivoting arm 21. Pivoting arm 21 is shown having an upper connecter 29 with an adjustment pin 51 for adjusting the force on the piston rod 28. Further, there is shown a pin or hook 39 mounted in or on the pivoting support arm 21 which has at the end an upper adjustable handle 38. In the preferred embodiment of the present invention, handle 38 is made of a resilient material which fits under the arm of the person using the walker. It will be understood that the release pins and adjustment pins shown and described in FIG. 6 may be flush mounted pins but are shown in their present form for illustration purposes only. The numerals used in FIG. 6 that are the same as those employed in FIGS. 2 to 5 show in greater detail the pins and recesses used to permit exact adjustment of height and position of the handles and support arms for a particular patient.

Figure 7:
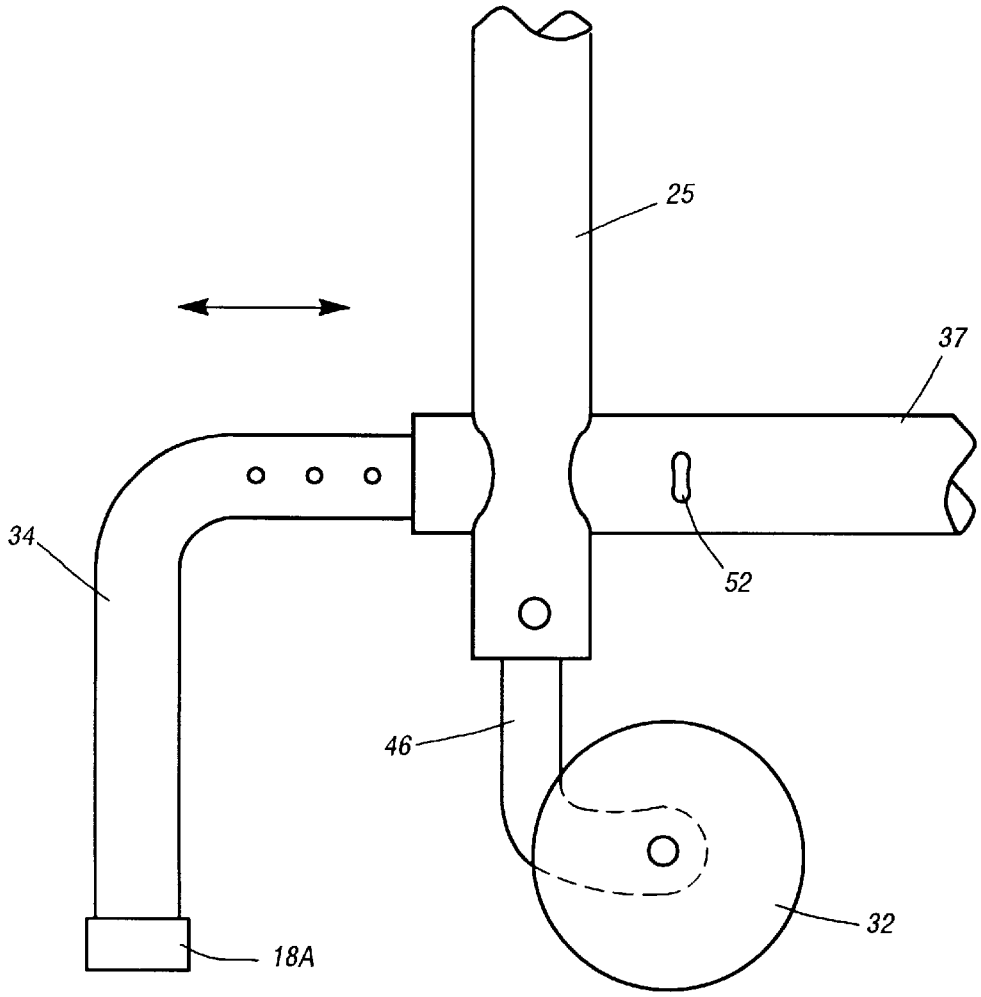
FIG. 7 is an enlarged detail of a front wheel and bumper outrigger with extension adjustments.

Refer now to FIG. 7 showing an enlarged detail of a front wheel and bumper outrigger with an extension adjustment. The hollow horizontal frame member 37 receives therein the horizontal portion of the front outrigger 34 having a rubber tip 18A an a locking pin 52 which locks the front outrigger inside of the hollow horizontal frame member 37. Wheel 32 is shown mounted on a swivel support 46 which extends into vertical leg 25. The wheel support may be permanently adjusted so as to provide ground clearance for the tip 18A but will prevent the walker from assuming an excessive tilt angle which would allow the walker to turn over or tilt while supporting the person using the walker.

Figure 8:
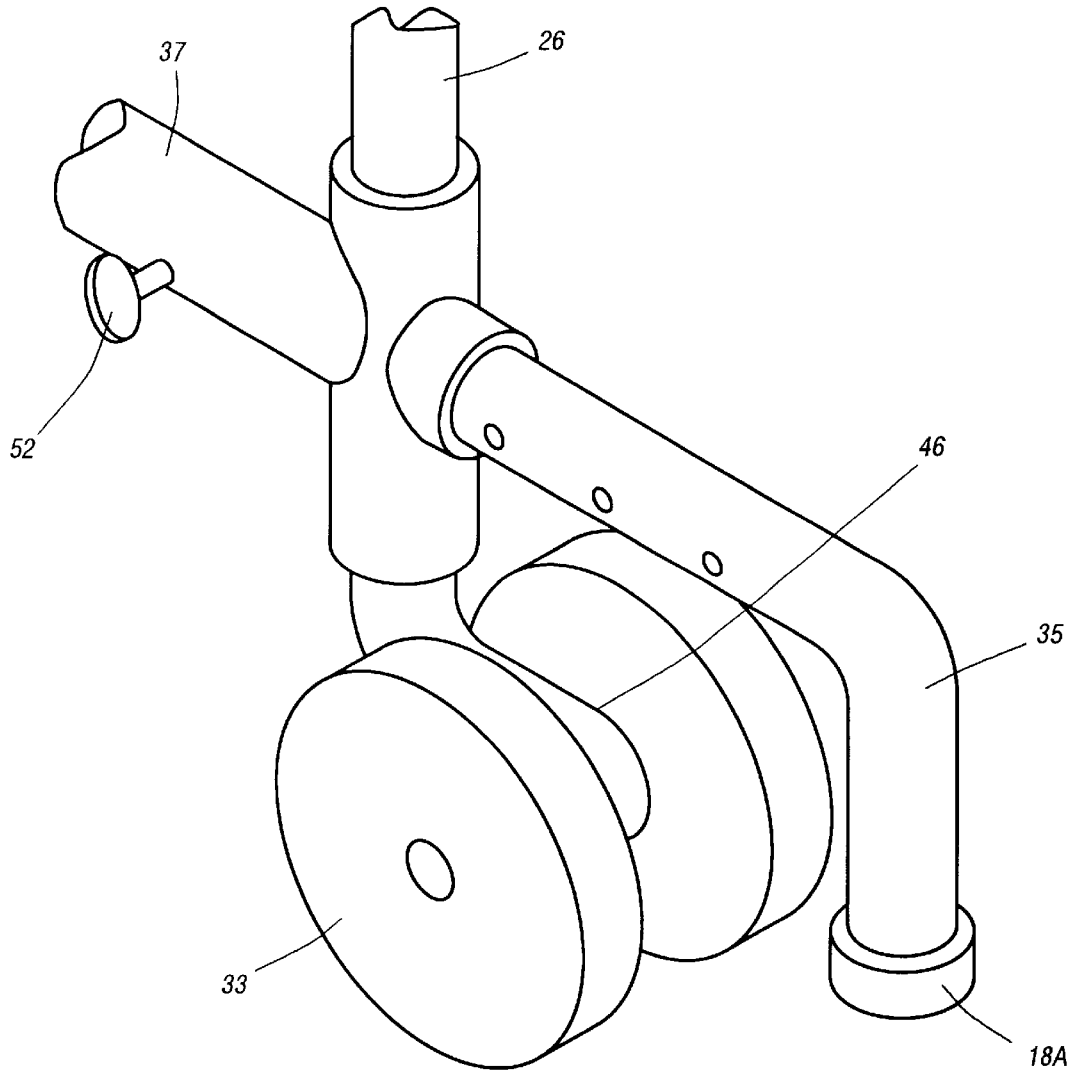
FIG. 8 is an enlarged detail of the rear wheel and bumper outrigger with extension adjustments.

Refer now to FIG. 8 showing an enlarged detail of a rear wheel and bumper outrigger with an extension adjustment. The horizontal frame member 37 is hollow and receives the horizontal portion of rear outrigger 35 also having a tip 18A and is fixed relative to the frame member 37 by a locking pin 52. The rear wheels may be swiveled but are preferably mounted on a swivel support 46 which is fixed relative to the rear vertical leg 26 by a pin or member not shown.

Figure 9:
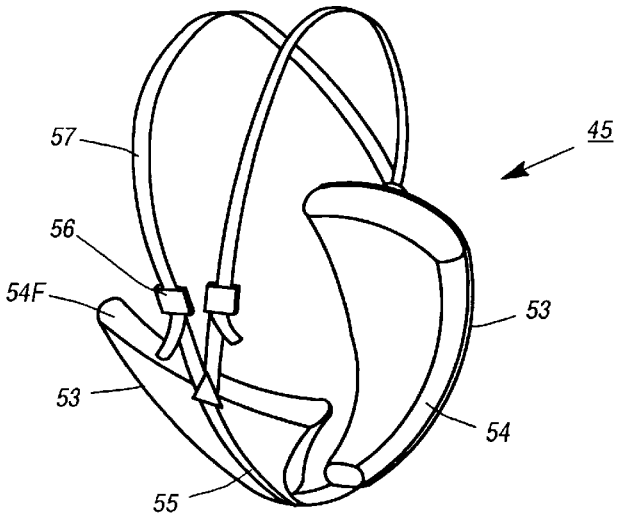
FIG. 9 is an enlarged detail of the preferred embodiment seat and harness which may be used to assist a person in standing up or sitting down as well as to permit walking with an adjustable supporting force and for removing strain on the hip and leg joints.

Refer now to FIG. 9 showing an enlarged detail of a preferred embodiment seat and harness 45 which may be used to assist a person in standing up or sitting down as well as providing support to a person needing an adjustable force support for relieving pressure on the hip and leg joints. The harness assembly 45 comprises an outer shell 53 which may be made from a molded plastic and having an inner resilient seat support 54 which comprises the rear seat. The front seat comprises molded shell 53 and resilient member 54F which are supported and positioned by a metal reinforcing member 55 which is connected to adjustable harness strap 57 which comprises flexible straps 57 and strap adjusters 56. In the preferred mode of operation the person or patient can easily slip into the harness so that the straps 57 extend upward on either side and may be hooked onto the hook or pin member 39 shown in FIG. 6. If the patient or person is strong enough they can walk into the walker and pivot the arms 21 and 22 down and hook onto the hook supports on the arms so as to provide support to the body of the patient or person using the walker. If the patient is not capable of hooking the harness 45 to the support arms 21 and 22 from a standing position, the patient may sit on the chair 44 and sequentially bring the arms 21 and 22 down to a horizontal position under the arms; then release the lift support of the pre-loaded gas springs 27 to assume a standing position as shown in FIG. 4.

Figure 10:
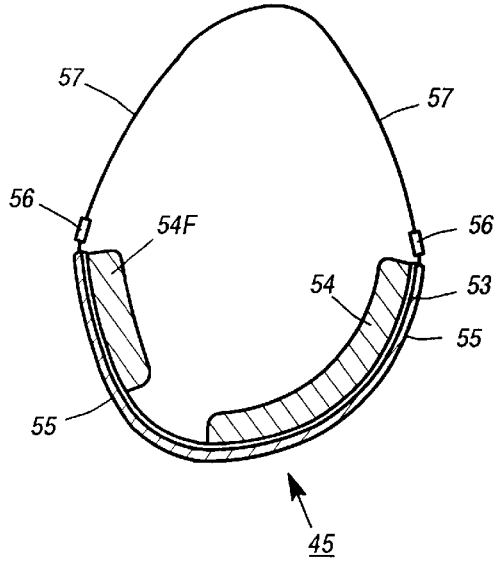
FIG. 10 is a side view of the seat and harness shown in FIG. 9.

Refer now to FIG. 10 showing a side view in section of the harness 45 and seat 54 shown in FIG. 9. The bar 55 is on the outside of the shell 53 and supports the front seat 54 and the rear seat 54F in the manner shown. In the preferred embodiment of the present invention the harness straps 57 extend completely under and around the shell 53 and are adjusted by the strap adjusters 56 as shown. It will be noted that the rear seat is designed to extend under the buttocks and provide a seat-like support when an upward force is applied to the harness straps 57.

Figure 11:
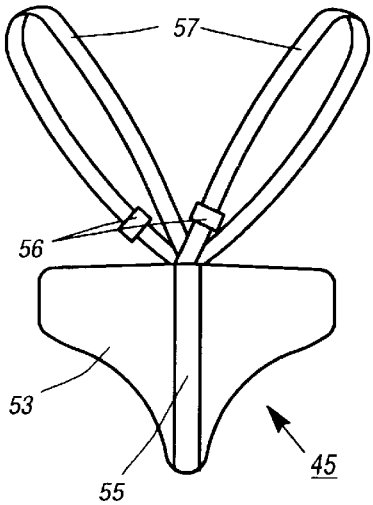
FIG. 11 is a front view of the seat and harness shown in FIGS. 9 and 10.

Refer now to FIG. 11 showing a front view of the harness assembly 45 shown in FIGS. 9 and 10. The outer shell 53 is contoured to fit between the legs of a male or female patient and provide upward support to the body. The metal reinforcing bar 55 is preferably made of a lightweight metal such as aluminum and prevents the resilient front and rear seat from compressing inward when an upward force is applied to the harness straps 57.

Having explained a preferred embodiment of the present invention it will be understood that the walker 20 shown as an assembly in FIG. 2 is provided with numerous adjustments to permit the walker to be adapted to persons of different height and weight. Different gas springs 27 may be employed in a range of support weights to accommodate persons weighing less than 100 pounds to over 300 pounds. The outriggers 34 and 35 may be adjusted so that a person using the walker over different types of terrain may have sufficient ground clearance so that the walker may be rolled without incurring a dragging force. The vertical legs 26 which include a horizontal member are designed to pivot or fold at flange member 50 so that the assembly 20 may be easily transported in the trunk of an automobile. Further, the commercially available gas springs 27 are provided with a locking mechanism (not shown) which permits the support arms 21 and 22 to be set in an extended upward position or locked in a horizontal or downward position as the case may be. The brake mechanism 42 may be a well-known level operated system of the type used on baby strollers.

Having explained a harness 45 of the type shown in FIGS. 9 through 11, it will be understood that other types of harnesses may be employed with the present invention. A typical trapeze harness comprises a pair of flexible leg belts connected to a flexible and adjustable waist belt which are provided with swivel connecters that connect to line supports. The swivel and line support of a trapeze harness permits the trapeze harness to completely rotate with the body while being supported by the waist harness. In the present preferred embodiment the harness 45 serves as a seat that provides a vertical lifting force to a patient or person who is walking or is arising from a seated position or is sitting down from a standing position. Thus, it will be understood that persons who previously could only walk short distances with prior art walkers are now provided with the means for walking longer and further than could heretofore be provided by prior art walkers. Further, persons who have had operations on hip and leg joints can start rehabilitation earlier and longer because the seat shown in FIGS. 9 to 11 is capable of being adjusted so that during rehabilitation the joint members are not injured during initial rehabilitation and the amount of force applied to the joints may be increased as the patient gains strength and muscle tone. Further, if there is no need for releasable force gas springs, any well known spring can be used to apply a lifting force on arms 21 and 22 such as coil or leaf springs properly mounted on the frame of the stand up walker.

Other modifications and changes may be made to the lifting arms and still maintain a lifting mode of operation to the body. In one such modification handles 38 have been shaped and padded to provide a lifting force under the arms of the patient. While such body lift mode restricts circulation of blood to the arms, handles 41 may be used to restore circulation.

What is claimed is:

1. A stand up full step walker for reducing the amount of movable body weight supported by a user's legs, comprising:

a support frame having a stable structured open to a full step of the user, roller means coupled to the bottom of said frame to permit said frame to be rolled, a pair of independently movable upper lift arms coupled to the top of said frame, pivot means for mounting each said lift arm to said frame for independently movement while walking, movable lift spring biasing means mounted between said frame and said upper lift arms, and movable body support means for transferring the weight of the patient in the walker into the independently moveable lift arms and to the movable lift spring biasing means and into said frame while walking.

2. A walker as set forth in claim 1 wherein said body support means comprises a body seat and harness, and means for fastening said harness to said upper lift arms.

3. A walker as set forth in claim 2 wherein said body seat comprises a rigid front seat and a rear seat which extend under the patient.

4. A walker as set forth in claim 1 wherein said body support means comprises upper arm support handles on said upper lift arms.

5. A walker as set forth in claim 4 wherein said upper arm support handles comprise a resilient material mounted on the outer end of said upper lift arms and adapted to support and lift the body by a force applied under the arm pits.

6. A walker as set forth in claim 1 wherein said lift spring biasing means comprises a gas spring for applying a lifting force to said upper lift arms.

7. A walker as set forth in claim 6 wherein said gas spring comprises a predetermined lifting force to said upper lift arms.

8. A walker as set forth in claim 7 which further include adjustors on said upper lift arms for adjusting said lifting force.

9. A walker as set forth in claim 8 which further includes adjustors on said frame for adjusting the height and position of said upper lift arms.

10. A walker as set forth in claim 9 which further includes a release means for releasing the force stored in each of said gas springs.

11. A stand up walker for reducing the amount of body weight support by a user's legs, comprising:

a support frame having a stable structure, roller means coupled to the bottom of the frame to permit said frame to be rolled, a pair of upper lift arms coupled to the top of said frame, pivot means for mounting said upper lift arms to said frame, lift spring biasing means mounted between said frame and said upper lift arms, body support means for transferring the weight of the patient in the walker into said upper lift arms and to said lift spring biasing means an into said support frame, and said body support means comprises a front seat and a rear seat which extend under the patient and further comprise a molded one-piece outer shell and inner resilient material bonded thereto.

12. A walker as set forth in claim 11 which further includes a rigid metal member mounted on the outside of said outer shell for maintaining the open form of said outer shell under force.

13. A walker as set forth in claim 12 wherein said harness further includes a plurality of straps connected to said rigid metal member for applying a lifting force to said outer shell.

* * * * *